US007299522B1

(12) United States Patent
Smith

(10) Patent No.: US 7,299,522 B1
(45) **Date of Patent: *Nov. 27, 2007**

(54) COMPRESSED AIR VACUUM CLEANER

(76) Inventor: Donald A. Smith, 2620 W. 1500 South, Vernal, UT (US) 84078

( * ) Notice: Subject to any disclaimer, the term of this patent is extended or adjusted under 35 U.S.C. 154(b) by 687 days.

This patent is subject to a terminal disclaimer.

(21) Appl. No.: 10/817,166

(22) Filed: Apr. 1, 2004

Related U.S. Application Data

(63) Continuation-in-part of application No. 10/055,857, filed on Jan. 25, 2002, now Pat. No. 6,826,799.

(51) Int. Cl.
*A47L 5/16* (2006.01)
*A47L 5/18* (2006.01)

(52) U.S. Cl. ..... 15/409; 15/353

(58) Field of Classification Search ..... 15/408, 15/409, 320, 353
See application file for complete search history.

(56) References Cited

U.S. PATENT DOCUMENTS

| | | | | |
|---|---|---|---|---|
| 1,762,142 | A * | 6/1930 | Breton | 15/320 |
| 1,986,476 | A | 1/1935 | Ironside | |
| 2,272,912 | A | 2/1942 | Heinkel | |
| 2,652,177 | A | 9/1953 | Lagemann | |
| 2,822,061 | A * | 2/1958 | Pettit et al. | 55/434 |
| 2,863,525 | A | 12/1958 | Lucian | |
| 2,867,835 | A | 1/1959 | Brown, Jr. et al. | |
| 3,452,751 | A | 7/1969 | Austin, Jr. | |
| 3,971,096 | A | 7/1976 | Renholt | |
| 4,915,245 | A | 4/1990 | Wouters et al. | |
| 5,142,730 | A | 9/1992 | Braks et al. | |
| 5,867,865 | A | 2/1999 | Obermuller et al. | |
| 6,049,941 | A | 4/2000 | Vollenweider, II | |

(Continued)

FOREIGN PATENT DOCUMENTS

DE 2521350 11/1976

(Continued)

OTHER PUBLICATIONS

Sump-N-Ator Sump Vacuum, Model #2108, www.industrial-vacuum-cleaner.com, web page advertisement Sep. 15, 2004.

(Continued)

*Primary Examiner*—Theresa T. Snider
(74) *Attorney, Agent, or Firm*—Thorpe North & Western LLP

(57) ABSTRACT

A vacuum cleaning device powered by compressed air includes a canister forming an internal collection chamber for collecting liquid and debris sucked up by the vacuum cleaning device. The vacuum includes a user operated drain from which liquid and debris collected in the collection chamber of the vacuum can be drained, when desired, and may also include a liquid extraction conduit extending into the collection chamber and attachable to a liquid pump for pumping liquid sucked up into the vacuum from the collection chamber. This makes draining the collection chamber much easier that in other vacuums. The vacuum device also includes a filter for air leaving the device which may include filter material in a filter housing over which a vacuum bag may be placed. A bypass in the filter housing may be opened to allow air from the device to bypass the filter material in the housing and pass directly into the vacuum bag.

23 Claims, 6 Drawing Sheets

U.S. PATENT DOCUMENTS

Figure 1:
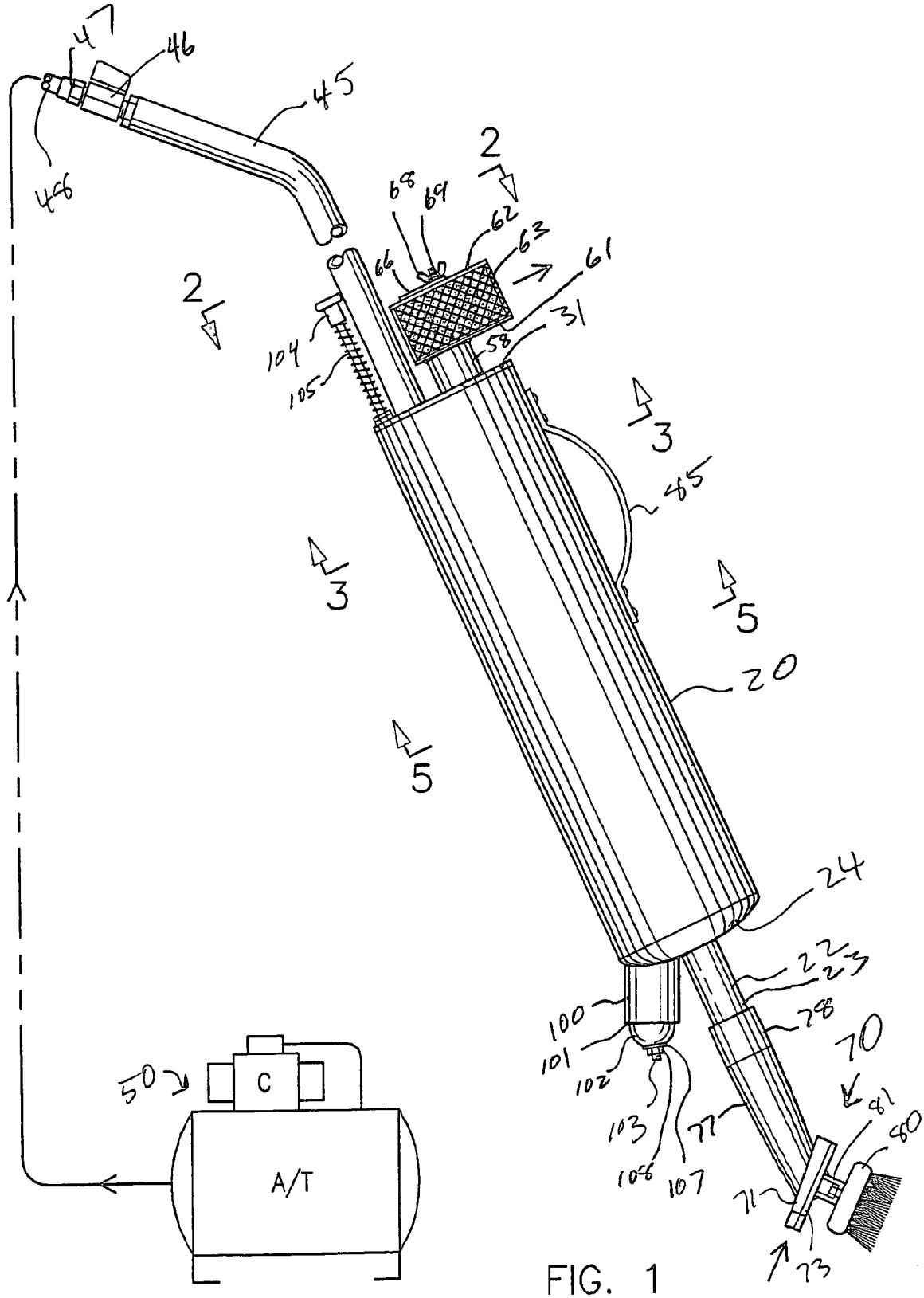

| | | | | |
|---|---|---|---|---|
| 6,243,912 | B1 * | 6/2001 | Grey | 15/320 |
| 6,338,750 | B1 | 1/2002 | Lorini | |
| 6,767,380 | B2 * | 7/2004 | von Stackelberg, Jr. | 55/431 |
| 6,826,799 | B2 * | 12/2004 | Smith | 15/409 |
| 7,203,994 | B2 * | 4/2007 | Smith | 15/409 |
| 2002/0116783 | A1 | 8/2002 | Giddings et al. | |

FOREIGN PATENT DOCUMENTS

| | | |
|---|---|---|
| RU | 2135065 | 8/1999 |

OTHER PUBLICATIONS

Nikro Industries, AWP15150, www.industrial-vacuum-cleaner.com, web page advertisement Sep. 15, 2004.

Nikro Industries, Compressed Air Venturi Series of Vacuums, www.industrial-vacuum-cleaner.com, web page advertisement Sep. 15, 2004.

XtractMax® Compressed Air Vacuums, Pulse Jet Series, www.industrial-vacuum-cleaner.com, web page advertisement Sep. 15, 2004.

Hand-D-Vac, Hendheld Industrial Vacuum, www.industrial-vacuum-cleaner.com, web page advertisement Sep. 15, 2004.

Jordan Power Equipment Co., DWD Air Powered Vac, www.jordan power.com, web page advertisement Sep. 2, 2004.

Jordan Power Equipment Co., Industrial Vacs, CFM Oil Vacuum, www.jordan power.com, web page advertisement Aug. 2, 2004.

* cited by examiner

COMPRESSED AIR VACUUM CLEANER

RELATED APPLICATION

This is a continuation-in-part of application Ser. No. 10/055,857, filed Jan. 25, 2002 now U.S. Pat. No. 6,826,799, and entitled "COMPRESSED AIR VACUUM."

BACKGROUND OF THE INVENTION

1. Field

The invention is in the field of vacuum cleaners that operate on compressed air.

2. State of the Art

Vacuum cleaners that operate on compressed air are known, see for example U.S. Pat. Nos. 2,863,525 and 5,142,730. Such vacuum cleaners operate from a source of compressed air such as available in many factories and garages. Electrical connection is unnecessary and the risk of electrical sparking eliminated. Further, such vacuum cleaners can produce high air flow and, as opposed to most electrical vacuums, the vacuum produced is increased as the flow of air into the vacuum is reduced. Such vacuums have been found particularly useful in industrial applications for liquid spill pickup. The inventor has found that such vacuums are particularly useful in automobile repair stations and shops where spills of oil, transmission fluid, antifreeze, gasoline, water, etc. occur during auto and truck repair.

The compressed air vacuum cleaner of the parent application, now patent No., is designed for automobile repair station and shop use and can easily and quickly pick up large amounts of spilled liquids as well as solids. However, with the vacuum cleaner of the patent, the top has to be removed to empty the vacuum cleaner. This is inconvenient and time consuming when large spills are being cleaned up as the vacuum canister can fill up quickly.

SUMMARY OF THE INVENTION

According to the invention, a compressed air vacuum includes a user operated drain from which the liquid and debris collected in the collection chamber of the vacuum can be drained, when desired, and may also include a liquid extraction conduit extending into the liquid collection chamber and attachable to a liquid pump for pumping liquid sucked up into the vacuum from the collection chamber. This makes draining the collection chamber much easier that in other vacuums. The vacuum includes a collection chamber in which liquid and particles sucked up by the vacuum collect. The collection chamber includes a drain opening, preferably at the bottom thereof, which is closed by a plug. The plug is connected to a user operated control by which the user can open the plug when the drain opening is placed over an area where the liquid in the chamber can be drained. The plug may be connected to a rod extending from the top of the chamber which a user can either push or pull against a bias to open the drain opening. A liquid extraction conduit may extend into the lower part of the chamber and may be connected to a source of vacuum from a liquid pump which pumps liquid from the chamber into a larger collection reservoir such as a fifty-five gallon drum. Such pump and drum are generally available in automobile repair stations and shops. Thus, for cleaning up oil on a garage floor, the vacuum cleaner of the invention can be operated to suck up the oil while at the same time the oil is pumped out of the vacuum cleaner collection chamber into the larger collection drum.

The preferred vacuum cleaner device of the invention includes an elongate canister having a top end, a bottom end, and an internal chamber. An elongate handle is secured to the canister and extends above the top end of the canister. The handle is used to hold and manipulate the vacuum cleaner device. A venturi and nozzle assembly in fluid flow communication with the top end of the internal chamber is adapted to be connected to a source of compressed air whereby compressed air is directed from the nozzle through the venturi to create a vacuum in the internal chamber. An outlet to the atmosphere is provided for exhausting air passing through the venturi. A vacuum intake pipe is secured to the canister with a bottom end of the pipe extending below the bottom end of the canister and with an upper end of the pipe extending into the chamber and terminating in fluid flow communication with the chamber intermediate the top and bottom of the chamber. A baffle deflector in the chamber is arranged with respect to the termination of the vacuum intake pipe in the chamber to deflect air and any debris and liquid entering the chamber from the vacuum pipe downwardly toward the bottom of the chamber. The liquid and debris collects in the bottom of the chamber as the air flow again changes direction and is drawn through the venturi and out of the chamber. The liquid and debris should be emptied from the chamber before it builds up to a level to cover the top of the vacuum inlet pipe, and preferably before reaching the bottom of the deflector.

THE DRAWINGS

Figure 2:
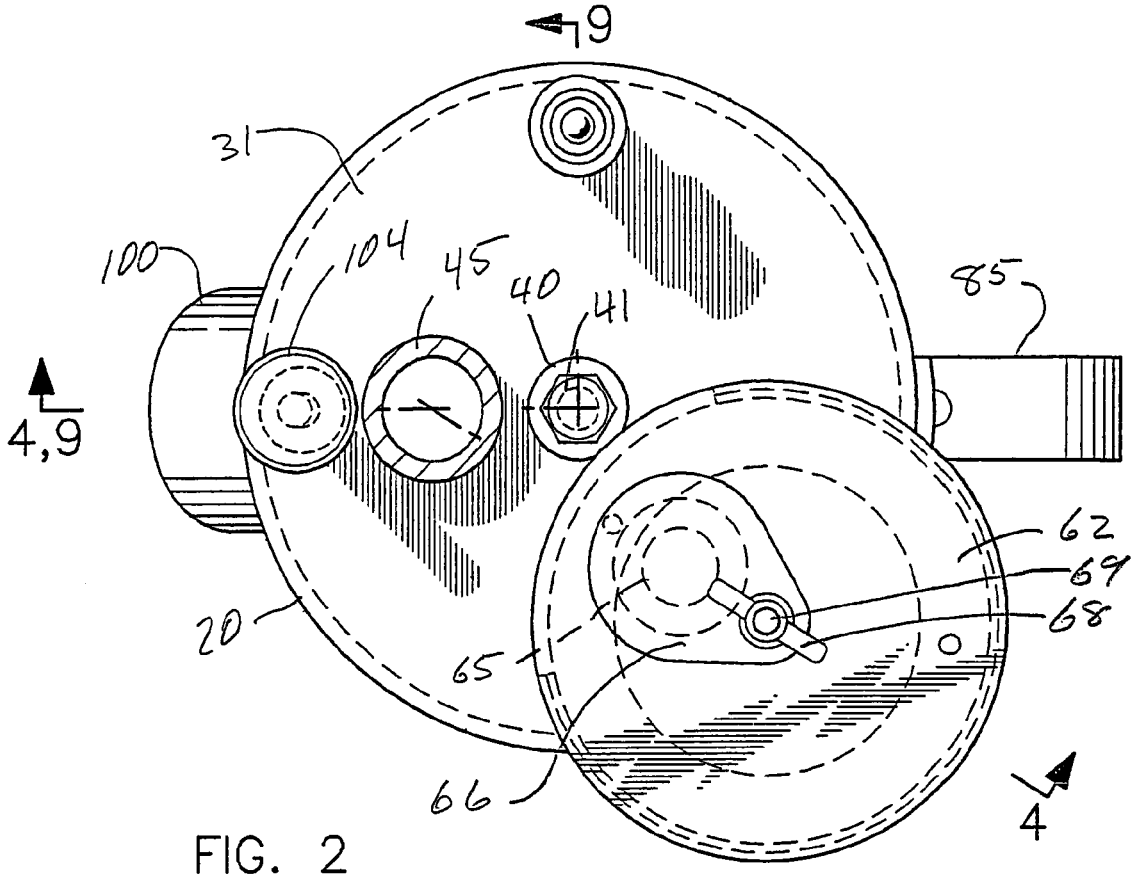
Figure 3:
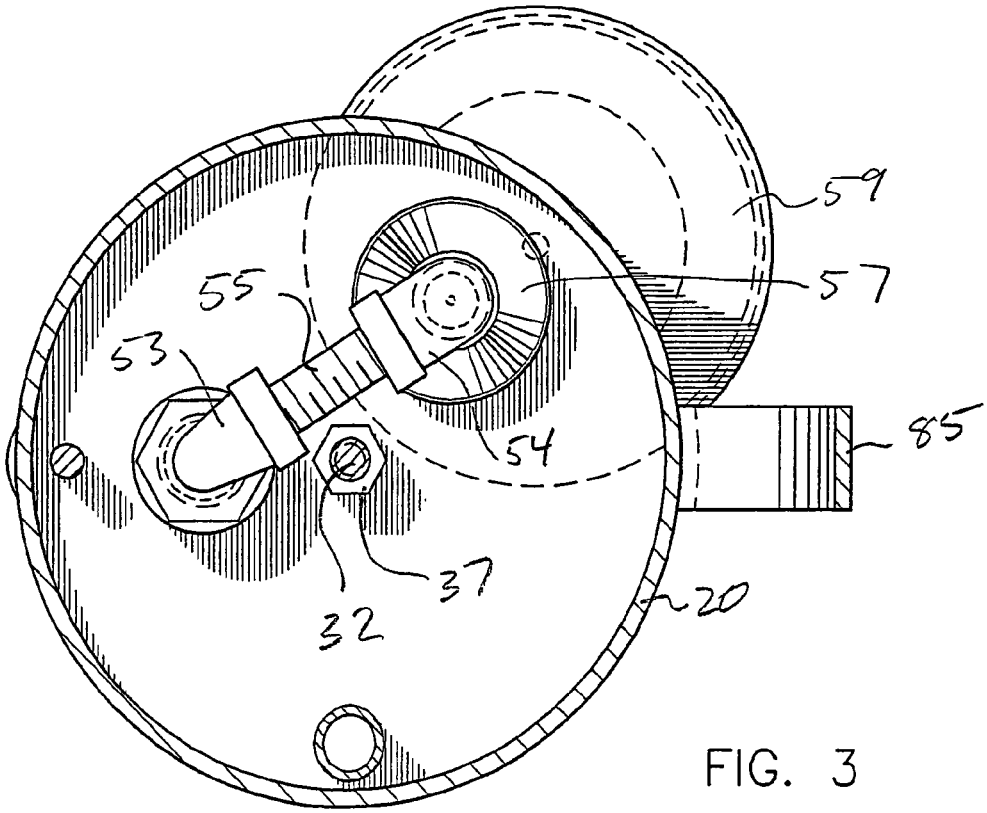
Figure 4:
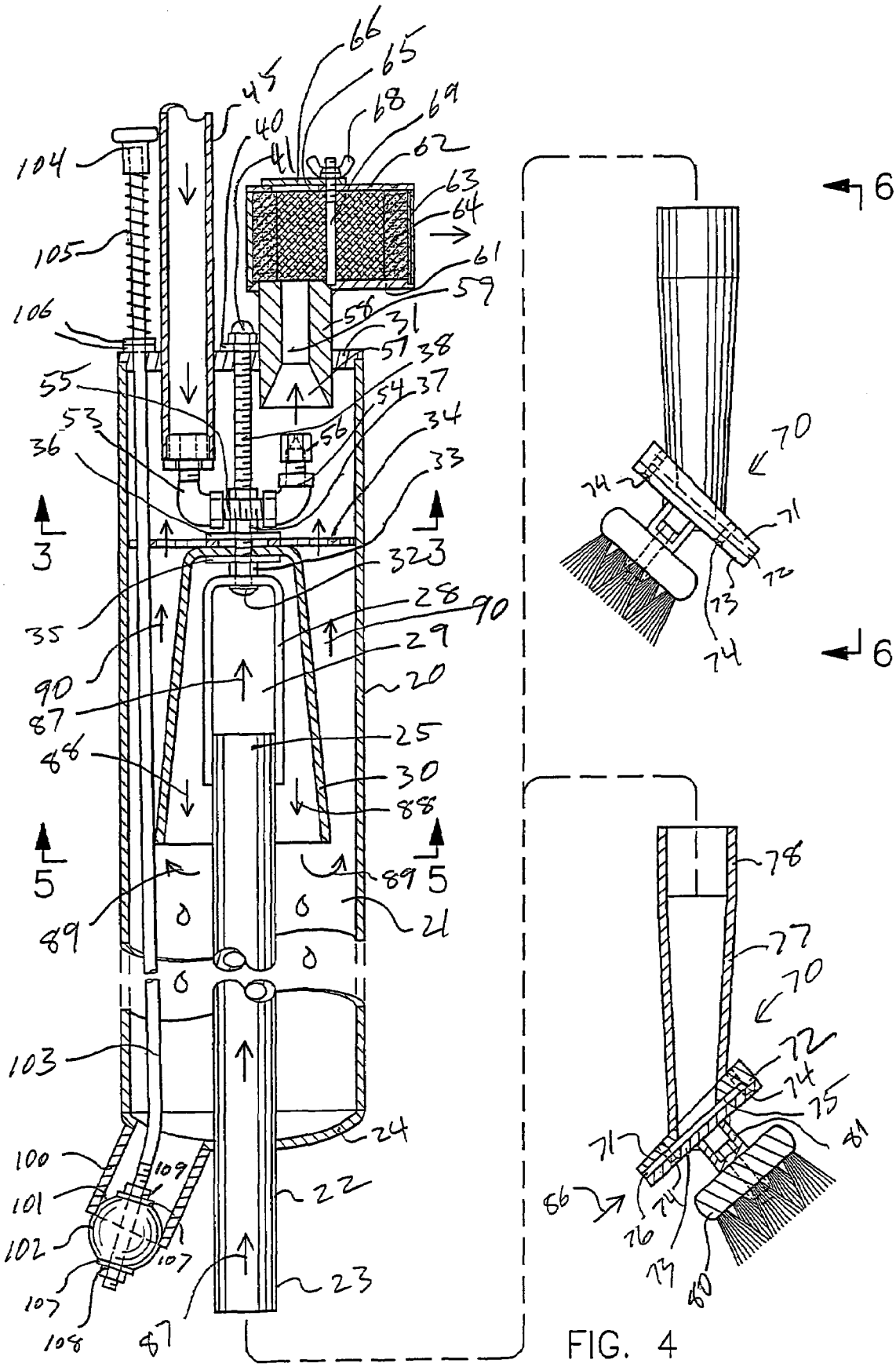
Figure 5:
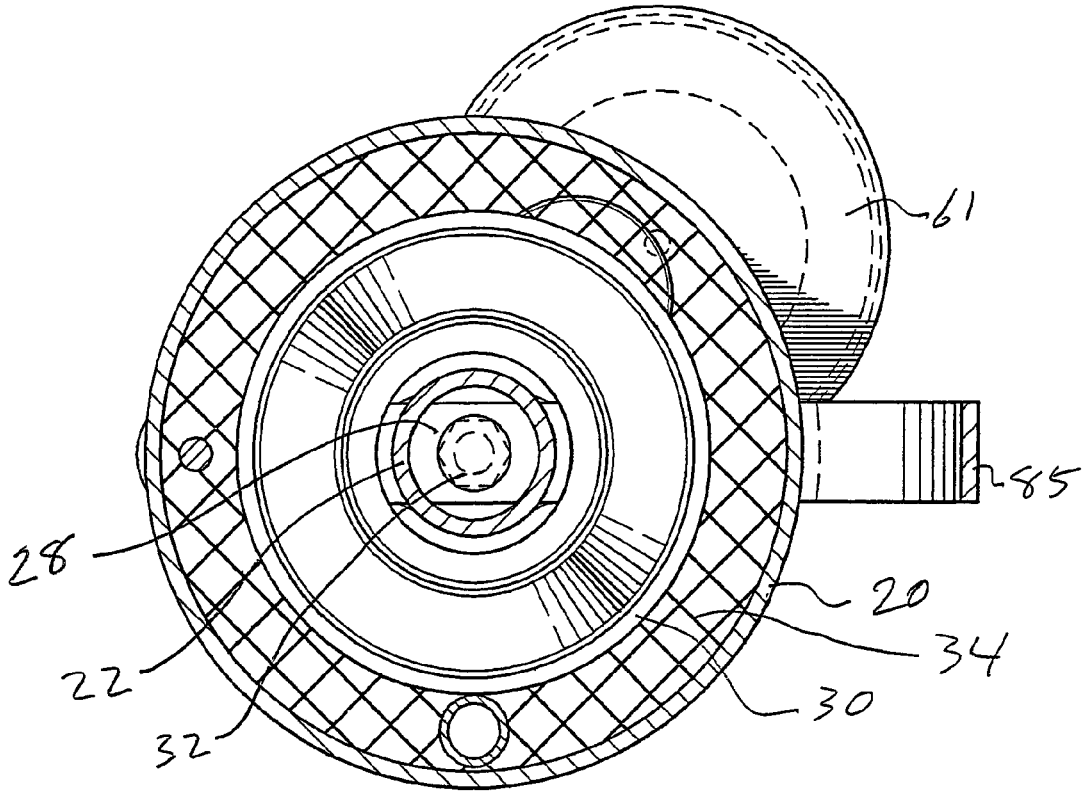
Figure 6:
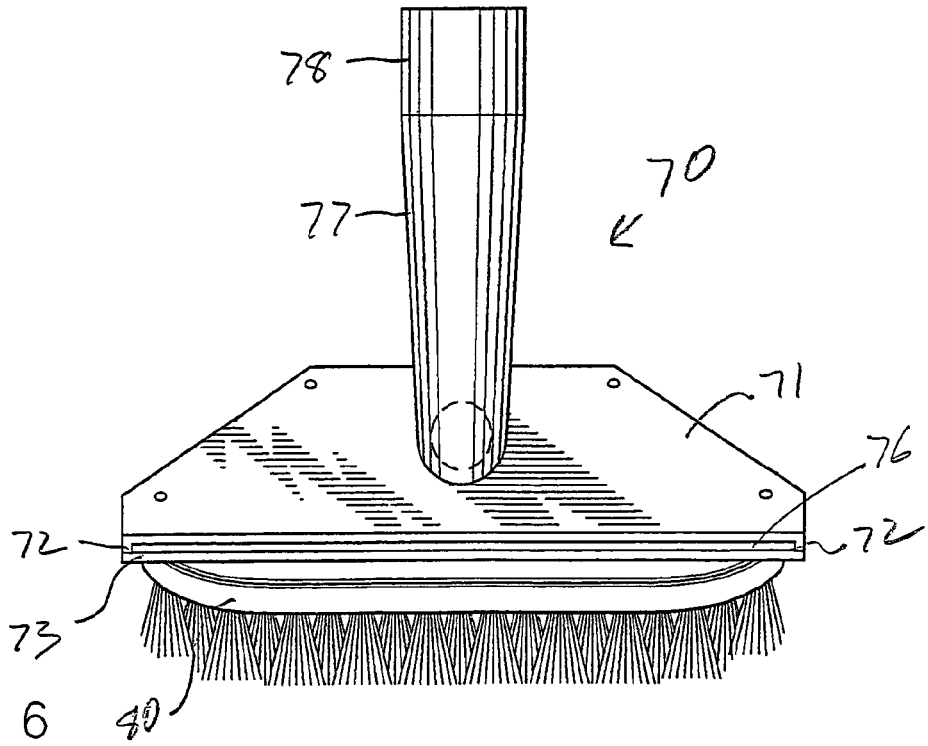
Figure 8:
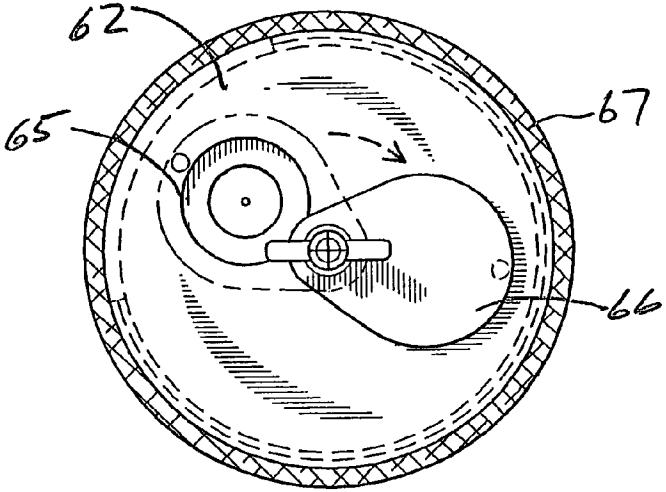
Figure 7:
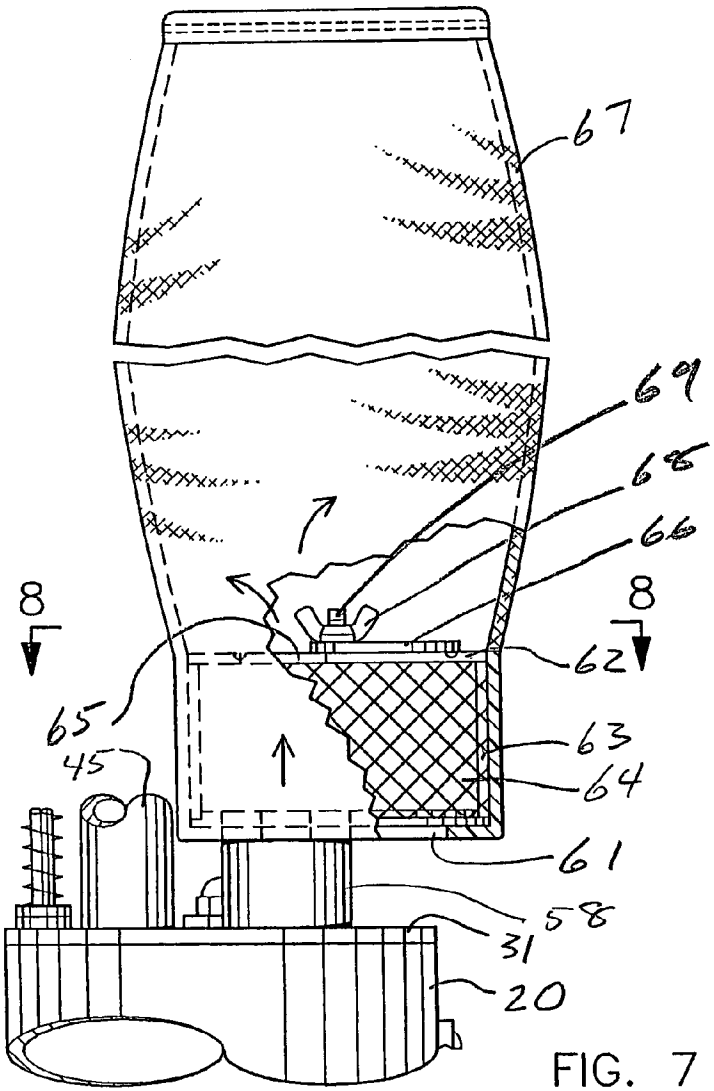
Figure 9:
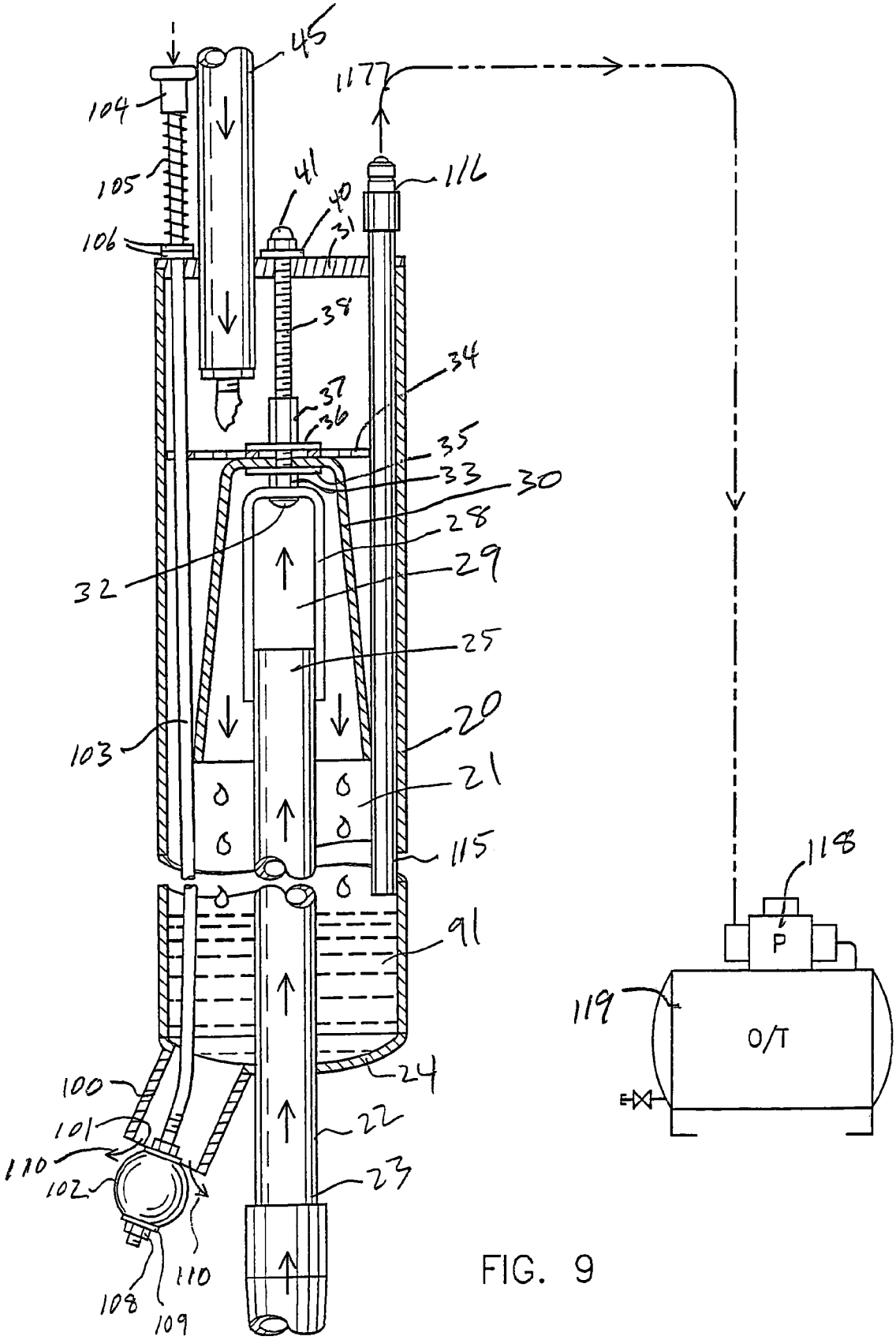

In the accompanying drawings, which show the best mode currently contemplated for carrying out the invention:

FIG. 1 is a side elevation of a vacuum cleaner of the invention with a schematic representation of a compressed air supply system connected to the vacuum cleaner;

FIG. 2, an enlarged top plan view taken on the line 2-2 of FIG. 1;

FIG. 3, an enlarged transverse section taken on the line 3-3 of FIG. 1;

FIG. 4, a shortened vertical section taken on the line 4-4 of FIG. 2 with the sectioned vacuum attachment in vacuum position and exploded from the vacuum intake pipe for clarity and the rotated vacuum attachment shown in elevation in brush position;

FIG. 5, an enlarged transverse section taken on the line 5-5 of FIG. 1;

FIG. 6, an enlarged elevation of the vacuum attachment shown in FIG. 4 and taken on the line 6-6 of FIG. 4;

FIG. 7, an enlarged fragmentary side elevation of the top portion of the vacuum with a portion of the vacuum bag broken away showing the filter housing with filter removed and a vacuum filter bag over the air outlet;

FIG. 8, an enlarged transverse section taken on the line 8-8 of FIG. 7; and FIG. 9, a reduced, shortened vertical section similar to that of FIG. 4, taken on the line 9-9 of FIG. 2, showing the drain in open position and showing schematically a liquid pump system attached to the vacuum to pump liquid from the vacuum.

DETAILED DESCRIPTION OF THE ILLUSTRATED EMBODIMENTS

The vacuum cleaner device of the invention, as shown in FIGS. 1, 4, and 9, includes an elongate canister 20 which forms an internal collection chamber 21 therein, FIGS. 4 and 9, for the collection of liquids and debris vacuumed up by the device. A vacuum intake pipe 22 is secured to the canister 20 so that its lower end 23 extends below the bottom end 24 of the canister and the vacuum intake pipe 22 extends into the canister with its upper end 25 terminating in the collection chamber 21 intermediate the top and bottom of the internal chamber 21, FIGS. 4 and 9. In the embodiment illustrated, the vacuum intake pipe 22 extends centrally through the bottom end 24 of the canister and is secured to the canister bottom end 24 by welding. A bracket 28, open at opposite sides 29, is secured, such as by welding, to the upper end 25 of vacuum intake pipe 22 and supports a deflector 30 in the internal chamber 21 of canister 20 and secures removable canister top end 31 to the canister. For this purpose, a bolt 32 extends through bracket 29 and is secured to bracket 29 by nut 33. Deflector 30 and a screen 34, sandwiched between washers 35 and 36, are held in place by internally threaded sleeve 37 which acts as a nut to tighten washers 35 and 36 against deflector 30 and screen 34 to secure them in chamber 21. Rod 38 is threaded into and extends upwardly from sleeve 37, best seen in FIG. 9, to above the top end of canister 20, and extends through a hole in canister top end 31 when top end 31 is in place in the canister. Canister top end 31 is secured in place by washer 40 and nut 41. With proper length of rod 38, nut 41 may be an acorn nut as shown. While bolt 32 could be long enough to extend through top end 31 to eliminate the separate threaded rod 38, the described construction with rod 38 is presently preferred for convenience of assembly so that a nut replacing sleeve 37 would not have to be threaded along the upper length of the bolt to position it against washer 36.

An elongate handle 45 is secured to and extends from the top of the canister and forms a handle by which the canister can be held and manipulated by a user. In the embodiment shown, the handle 45 is secured by welding to removable canister top end 31 and takes the form of a pipe which extends through top end 31. This pipe, which forms handle 45, also serves as a compressed air inlet to the vacuum cleaner device. An air control valve 46, FIG. 1, and air hose coupling 47, preferably a quick connect coupling, are secured to the outer end of handle 45. A hose 48 attached to hose coupling 47 connects the handle pipe 35 to a source of compressed air, shown as air compressor 50. The inner end 52 of handle pipe 45, FIG. 4, terminates near the upper end of internal chamber 21 with elbow fittings 53 and 54 and nipple 55 therebetween forming a U shape to direct flow of compressed air from the pipe back toward the top end of the canister. A nozzle 56 directs the compressed air toward and through venturi 57 in tubular fitting 58 which extends through canister top end 31. Air flow through venturi 57 creates a vacuum in chamber 21, which is the source of vacuum for the vacuum cleaner. It has been found that spacing of about one quarter inch from the nozzle 56 to the entrance of venturi 57 creates a satisfactory vacuum in chamber 21. Air passing through the venturi 57, which includes both the compressed air from nozzle 56 and air flowing from the chamber 21, flows through passage 59 to filter 60 which includes lower filter plate 61 and removable upper filter plate 62 held in spaced relation by screen 63. Filter material 64 is placed inside screen 63 to filter air flowing from the venturi and to muffle the sound. However, since the filter material 64, such as an open cell foam filter material, fills up and plugs relatively rapidly, the top plate of the filter includes an opening 65 with closing cover plate 66 which can be moved to open opening 65 into a filter bag 67, such as a normal vacuum cleaner bag, which may be positioned as shown in FIG. 7. Upper filter plate 62 and closing cover plate 66 are held in place by wing nut 68 threaded onto threaded stud 69. Generally, in vacuuming liquids, cover plate 66 will be positioned over opening 65 so that air will pass through filter material 64. When vacuuming dry and dusty materials, cover plate 66 can be moved so that the air from the vacuum bypass the filter material and flows into and through the filter bag 67 which catches the dust and has a much greater filter area than filter material 64 so does not clog up as rapidly. Upper filter plate 62 can be removed by removal of wing nut 68 so that filter material 64 can be removed and cleaned or replaced.

A vacuum attachment end, such as vacuum attachment end 70, FIGS. 1, 4, and 6, is removably telescopingly frictionally attached to the bottom end 23 of vacuum inlet pipe 22. The illustrated vacuum attachment end 70 is formed of top plate 71 having a peripheral lip 72 extending about the periphery on all but one side of the plate secured to flat bottom plate 73, such as by screws 74, to create a flow space 75 between the plates with opening 76 along one side. Tapered pipe 77 extends from top plate 71 with the inside of pipe 71 in flow communication with flow space 75. Larger end 78 telescopes over lower end 23 of vacuum inlet pipe 22 to frictionally engage it. A brush 80 is bolted to bracket 81 extending from bottom plate 73.

In operation, compressed air, preferably between about ninety and one hundred fifty PSI, is fed through the handle pipe 45 and is expelled through nozzle 56 toward the venturi 57. The compressed air flows through venturi 57 and causes air in the chamber 21 to also flow through the venturi, setting up a flow of air through vacuum attachment end opening 76, flow space 75, pipe 77, and vacuum inlet pipe 22 into chamber 21. The vacuum device is held and manipulated by a user by handle 45 in normal manner for an upright vacuum cleaner, and, if needed, also by handle 85, FIG. 1, and vacuum attachment end opening 76 is moved over a surface to be cleaned and through the dirt or liquid to be picked up. The dirt or liquid to be picked up is sucked into vacuum attachment end opening 76, as indicated by arrow 86, FIG. 4, and then through flow space 75, pipe 77, and vacuum inlet pipe 22, as shown by arrows 87, into chamber 21 where its direction of travel is substantially reversed and directed downwardly by deflector 30, as shown by arrows 88, and the air flow continues around the bottom of deflector 30 and then upwardly, as shown by arrows 89 and 90, respectively, to venturi 57 and out to the atmosphere through the filter material or the vacuum bag, whichever is being used at the time. Any liquid or debris that is sucked into chamber 21, because it is relatively heavy, will fall to the bottom of the chamber after being deflected by deflector 30 and generally only air and small airborne particles, such as dust, will flow out through the venturi. The liquid and relatively heavy debris will collect and build up in the bottom portion of the chamber 21 as shown by the liquid buildup 91, FIG. 9. Where a large liquid spill is being vacuumed up, the chamber 21 will fill up quite rapidly. The vacuum device can also be manipulated during use so that brush 80 can be used to loosen dirt which can then be vacuumed up by the vacuum device.

With prior art vacuums and with the vacuum device of my priority application, it is necessary to remove the top of the canister and tip the canister over to empty liquid and debris collected in the canister. However, the vacuum device of the invention provides a drain 100, FIGS. 1, 4, and 9, with a drain opening 101. A plug 102, here an elastomeric ball, normally blocks the drain opening and is user operated to move out of the drain opening when desired to drain the chamber 21. In the illustrated embodiment, the elastomeric ball 102 is secured to a rod 103 which extends upwardly through the drain opening 101, drain 100, chamber 21, and through the canister top 31 to terminate in handle 104 above the top of the canister. A spring 105 positioned between washers 106 and handle 104 biases rod 103 upwardly to bias elastomeric ball 102 into drain opening 101 to close it as shown in FIGS. 1 and 4. Plug 102 is held in place on rod 103 by washers 107 and nuts 108 and 109 threaded onto the lower end portion of rod 103. When a user wants to open the drain, the user pushes downwardly on handle 104 against the bias of spring 105 to move the elastomeric ball 102 out of drain opening 101 to open the drain as shown in FIG. 9. This allows any liquid in chamber 21 to drain out through drain opening 101 as shown by arrows 110, FIG. 9. The vacuum device will normally be held over a collection vessel during draining so the liquid drains from the vacuum device into the collection vessel.

When cleaning up a relatively large liquid spill, the collection chamber 21 will fill up rapidly and may need to be drained several times during clean up. If desired, liquid extraction conduit 115, FIG. 9, may be provided extending through canister 20 into collection chamber 21. As shown, liquid extraction pipe 115 can extend through canister top end 31 down into the lower portion of collection chamber 21, below the bottom of deflector 30 and preferably toward chamber bottom end 24. Liquid extraction conduit 115 may be secured, such as by welding, to canister top end 31.

Liquid extraction conduit 115 terminates at its top end in a quick connect connector 116 which connects to a hose, indicated schematically by 117, connected to a vacuum source such as a vacuum pump 118 on a collection reservoir 119, such as a fifty five gallon drum. Such collection reservoirs and associated vacuum pumps are often available in automotive service stations and garages. With hose 117 connected to liquid extraction conduit 115 and vacuum pump 118 operating, liquid in collection chamber 21 is sucked out of chamber 21 into collection reservoir 119. With the vacuum device of the invention operating and with vacuum pump 118 connected to liquid extraction conduit 115 and operating, the vacuum device of the invention can be used to clean up large liquid spills without having to stop to drain collection chamber 21. In such case, the only limiting factor is the capacity of collection reservoir 119.

Whereas the invention is here illustrated and described with reference to embodiments thereof presently contemplated as the best mode of carrying out the invention in actual practice, it is to be understood that various changes may be made in adapting the invention to different embodiments without departing from the broader inventive concepts disclosed herein and comprehended by the claims that follow.

The invention claimed is:

1. A vacuum cleaning device powered by compressed air, comprising:

an elongate canister having a top end, a bottom end, and an internal chamber;

an elongate handle secured to the canister and extending above the top end of the canister and by which the canister can be held and manipulated;

a venturi and nozzle assembly in fluid flow communication with the top end of the internal chamber adapted to be connected to a source of compressed air whereby compressed air is directed from the nozzle through the venturi to create a vacuum in the internal chamber and having an outlet for air passing through the venturi;

a vacuum intake pipe secured to the canister and extending below the bottom end of the canister and into the chamber terminating in fluid flow communication with the chamber intermediate the top and bottom of the chamber;

a baffle deflector in the chamber arranged with respect to the termination of the vacuum intake pipe to deflect air and any debris and liquid entering the chamber from the vacuum pipe downwardly toward the bottom of the chamber;

a drain opening for draining liquid and debris from the chamber;

means for closing the drain opening to prevent liquid and debris in the chamber from draining through the drain opening; and user operated means for opening the drain opening when desired to drain liquid and debris from the chamber.

2. A vacuum cleaning device according to claim 1, wherein the means for closing the drain opening is a plug.

3. A vacuum cleaning device according to claim 2, wherein the plug is biased into the opening to close it.

4. A vacuum cleaning device according to claim 3, wherein the user operated means for opening the drain opening moves the plug against the bias out of position closing the drain to open the drain.

5. A vacuum cleaning device according to claim 4, wherein the user operated means for opening the drain includes a shaft connected to the plug so the plug moves with longitudinal movement of the shaft, a spring biasing the shaft to move the plug into the drain opening, and a handle on the shaft by which a user can move the shaft against the spring bias to open the drain.

6. A vacuum cleaning device according to claim 5, wherein the drain opening extends through the bottom end of the canister, the shaft extends through the top end of the canister, and the handle on the shaft is located above the top of the canister.

7. A vacuum cleaning device according to claim 6, wherein the spring extends between the top end of the canister and the handle.

8. A vacuum cleaning device according to claim 1, additionally including a conduit extending into the chamber through which liquid can be pumped from the chamber.

9. A vacuum cleaning device according to claim 8, wherein the conduit is adapted to be connected to a liquid pump.

10. A vacuum cleaning device according to claim 9, wherein the conduit extends through the top of the canister into the chamber.

11. A vacuum cleaning device according to claim 1, additionally including a filter around the outlet for air passing through the venturi.

12. A vacuum cleaning device according to claim 11, wherein the filter is a vacuum cleaner bag removably positioned around the outlet.

13. A vacuum cleaning device according to claim 11, additionally including a housing about the outlet for air passing through the venturi, and wherein the filter is a vacuum cleaner bag removably positioned around the housing.

14. A vacuum cleaning device according to claim 13, additionally including filter material held in the housing.

15. A vacuum, cleaning device according to claim 14, wherein the housing additionally includes a bypass opening which can be opened when desired to allow air passing through the venturi to bypass the filter material held in the housing and pass directly into the vacuum cleaner bag.

16. A vacuum cleaning device according to claim 11, additionally including a housing about the outlet for air passing through the venturi, and wherein the filter is filter material held in the housing.

17. A vacuum cleaning device according to claim 16, wherein the filter material acts as a muffler.

18. A vacuum cleaning device according to claim 1, additionally including attachment ends for the vacuum intake pipe.

19. A vacuum cleaning device according to claim 16, wherein an attachment end for the vacuum intake pipe forms an end for sliding across a floor to vacuum up a liquid on the floor.

20. A vacuum cleaning device according to claim 17, wherein the attachment also includes a brush for brushing the floor.

21. A vacuum cleaning device powered by compressed air, comprising:

an elongate canister having a top end, a bottom end, and an internal chamber;

an elongate handle secured to the canister and extending above the top end of the canister and by which the canister can be held and manipulated;

a venturi and nozzle assembly in fluid flow communication with the top end of the internal chamber adapted to be connected to a source of compressed air whereby compressed air is directed from the nozzle through the venturi to create a vacuum in the internal chamber and having an outlet for air passing through the venturi;

a vacuum intake pipe secured to the canister and extending below the bottom end of the canister and into the chamber terminating in fluid flow communication with the chamber intermediate the top and bottom of the chamber;

a baffle deflector in the chamber arranged with respect to the termination of the vacuum intake pipe to deflect air and any debris and liquid entering the chamber from the vacuum pipe downwardly toward the bottom of the chamber; and a conduit extending into the chamber through which liquid can be pumped from the chamber.

22. A vacuum cleaning device according to claim 19, wherein the conduit is adapted to be connected to a liquid pump.

23. A vacuum cleaning device according to claim 20, wherein the conduit extends through the top of the canister into the chamber.

* * * * *